US007809115B2

(12) United States Patent
Allen et al.

(10) Patent No.: US 7,809,115 B2
(45) Date of Patent: Oct. 5, 2010

(54) DIODE FOR FLASH RADIOGRAPHY

(75) Inventors: Raymond J Allen, Vienna, VA (US); Gerald Cooperstein, Rockville, MD (US); Joseph W Schumer, Falls Church, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/207,039

(22) Filed: Sep. 9, 2008

(65) Prior Publication Data

US 2010/0061517 A1 Mar. 11, 2010

(51) Int. Cl.
*H01J 35/06* (2006.01)
*H01J 35/08* (2006.01)
*H01J 35/30* (2006.01)

(52) U.S. Cl. ..... 378/136; 378/137; 378/138

(58) Field of Classification Search ..... 378/119, 378/121, 136, 143; 250/423 R, 424, 426, 250/493.1

See application file for complete search history.

(56) References Cited

U.S. PATENT DOCUMENTS 2,505,095 A * 4/1950 Burnside ..... 313/246
2,886,725 A * 5/1959 Yanagisawa ..... 378/136
3,883,760 A * 5/1975 Cunningham, Jr. ..... 378/122
4,379,977 A * 4/1983 Carmel et al. ..... 378/136
4,924,485 A * 5/1990 Hoeberling ..... 378/102
5,469,490 A * 11/1995 Golden et al. ..... 378/122
6,064,718 A * 5/2000 Holland et al. ..... 378/122
6,205,200 B1 * 3/2001 Boyer et al. ..... 378/101
6,240,163 B1 * 5/2001 Zhang et al. ..... 378/122
6,379,210 B2 * 4/2002 Xu et al. ..... 445/50
6,922,455 B2 * 7/2005 Jurczyk et al. ..... 376/144
7,502,446 B2 * 3/2009 Dotten et al. ..... 378/119

OTHER PUBLICATIONS

G. Cooperstein et al., "A High-Impedance, High-Resolution, 1-MV Radiography Diode", International Conference on Plasma Science, Jun. 4-8, 2006, Traverse City, Michigan, Conference Record-Abstracts.

* cited by examiner

*Primary Examiner*—Edward J Glick
*Assistant Examiner*—Anastasia Midkiff
(74) *Attorney, Agent, or Firm*—Amy L. Ressing; L. George Legg

(57) ABSTRACT

A flash radiography diode includes a cathode and an anode. The cathode includes a frustum member with a bore extending through the frustum member. The anode is a tapered anode made of an electrically conductive material and oriented toward the cathode. The anode and the cathode are housed in a chamber with a gap between the anode and the cathode. The cathode is configured to emit electrons to the tapered anode, which electrons strike the anode and create an anode plasma. The anode plasma creates X rays which propagate from the anode.

32 Claims, 8 Drawing Sheets

DIODE FOR FLASH RADIOGRAPHY

BACKGROUND

1. Field of the Invention

This invention relates to an X-ray diode source for flash radiography.

2. Description of the Related Art

Flash radiography is a technique used to take stop-action pictures of dynamic events. Such dynamic events may include detonation of high explosives or implosion of a mock weapon assembly containing a surrogate material to represent a nuclear core. An apparatus for flash radiography uses one or more diodes to generate a short X-ray pulse. Transmitted flux from a number of X-ray photons per unit area is then recorded on a shielded detector. Diodes useful for flash radiography produce an intense electron beam, which efficiently propagates beam energy along an anode. The efficient propagation of an intense electron beam is highly desirable for many reasons. One advantage is application of beam energy from a sufficient distance to avoid damage to the power source. Another advantage is an ability to confine a target to a specific location. Such features may enable irradiation of a solid target pellet for material response studies, produce and heat high-temperature plasmas and produce an intense localized source of X rays.

Existing devices for producing an intense flow of electrons include the dielectric-rod-cathode diode (Bennett diode), planar and hemispherical pinched electron-beam diodes and planar diodes with exploding wires on axis. These devices propagate electron beams with relatively low efficiency. Other techniques for propagating beams include exploding-wire discharge channels, z-pinch discharge guides and laser-initiated discharges. These techniques guide a beam through a preformed plasma discharge. A propagation efficiency reported for these techniques, however, does not exceed 50%. Moreover, these techniques usually require large, expensive and complex external equipment.

Pinch propagation along rod--and cylindrical-shaped anodes of a diode for producing a multimicrosecond pulse of X rays has been observed by K. F. Zelenskii, O. P. Pecherskii, and V. A. Tsukerman (Soviet Physics-Technical Physics, Vol. 13, No. 9, March, 1969, pp 1284-1289). The Zelenskii device operates at high impedance (approximately 200 ohms) and the anode includes a cylinder having either a small constant radius providing a slow pinch formation and very low currents or a large constant radius resulting in higher current but comparatively slow pinch propagation and low current density. Although the Zelenskii device forms an anode surface plasma, the anode, because of its shape and material, may not produce high ion fluxes, form and propagate fast pinch or operate at low impedance.

SUMMARY

In one aspect a flash radiography diode comprises a cathode with a frustum member and a bore extending through the frustum member, a tapered anode comprising an electrically conductive material, the cathode and the tapered anode housed in a chamber, wherein the cathode is configured to emit an electrical pulse to the tapered anode and a gap between the tapered anode and the frustum member.

In some embodiments the cathode comprises carbon. In some embodiments the tapered anode comprises at least one material selected from the group consisting of brass, copper, tungsten, tungsten alloy, stainless steel, lead and tantalum. In some embodiments a taper of the tapered anode is 20 degrees.

In some embodiments the frustum member comprises a cylindrical portion. In some embodiments the frustum member further comprises a flange. In some embodiments the flange is at least partially coated with carbon. In some embodiments the frustum member projects from a base of the cathode towards the tapered anode. In some embodiments the bore comprises a conical shape comprising a first opening with a first diameter and a second end with a second diameter, the first diameter smaller than the second diameter and the first end located closer to the tapered anode than the second end. In some embodiments the frustum member extends from the base of the cathode away from the tapered anode. In some embodiments the gap comprises an axial gap between the tapered anode and the bore and wherein the axial gap is between 1 and 3 mm.

In some embodiments the anode comprises a coating element with an atomic number greater than 55. In some embodiments the element is tungsten or uranium. In some embodiments non-tip portions of the tapered anode comprise a carbon coating configured to increase ion emission threshold. In some embodiments non-tip portions of the tapered anode comprise at least one material selected from the group consisting of an element having an atomic number less than 55, carbon, aluminum or titanium, the at least one material configured to increase the ion emission threshold of the anode. In some embodiments the bore is coaxial with the tapered anode. In some embodiments the tapered anode is replaceable. In some embodiments the non-tapered portion of the tapered anode comprises a hollow rod. In some embodiments the hollow rod comprises at least one element with an atomic number less than 55. In some embodiments the cathode is connected to ground. In some embodiments the chamber is an evacuated chamber. In some embodiments the cathode comprises a carbon coating or a carbon insert. In some embodiments the cathode comprises an anodized aluminum configured to minimize plasma production on the remainder of the cathode.

In another aspect a system for flash radiography comprises a flash radiography diode coupled to a positive polarity voltage pulse generator.

In another aspect a method of operating a flash radiography diode comprises providing an electrical pulse from a voltage pulse generator to a cathode, propagating electrons from an outer surface of a frustum member of the cathode across a gap to a tapered anode and emitting an X ray from a tip of the tapered anode through a bore in the cathode, the bore comprising a smaller diameter close to the tapered anode and a larger diameter further from the tapered anode.

In some embodiments the method further comprises heating the anode. In some embodiments the method further comprises forming plasma on a high-field stressed portion of the frustum member. In some embodiments the electrons from the plasma strike a tip of the tapered anode. In some embodiments propagating electrons comprises electrostatically focusing electrons emitted from the cathode towards a tip of the anode. In some embodiments the method further comprises forming an anode plasma on the tip of the anode because of high electron flux. In some embodiments the method further comprises expanding anode plasma in a primarily radial direction.

In another aspect a method of generating ions comprises providing an electrical pulse from a voltage pulse generator, propagating electrons from a cathode to an anode, the cathode connected to the voltage pulse generator and the anode comprising an element to be ionized and ionizing gas molecules emitted from the anode surface. In some embodiments the anode comprises a deuterated plastic. In some embodiments ionizing gas molecules comprises generating neutrons.

In another aspect a method of making a flash radiography diode comprises forming a cathode comprising a planar member and a frustum member, a bore extending through the frustum member and the planar member, forming a tapered anode comprising an electrically conductive material, placing the tapered anode in a coaxial position from the bore of the frustum member such that a gap exists between the tapered anode and the frustum member, and forming a chamber housing the cathode and the tapered anode.

In some embodiments the method further comprises evacuating the chamber. In some embodiments the method further comprises connecting the cathode to ground. In some embodiments the tapered anode comprises at least one material selected from the group consisting of brass, copper, stainless steel, lead, aluminum, tungsten, tungsten alloy and tantalum. In some embodiments the frustum member further comprises a flange. In some embodiments the method further comprises coating the flange with carbon. In some embodiments the cathode comprises carbon. In some embodiments the cathode comprises a carbon coating, a carbon insert or anodized aluminum. In some embodiments the method further comprises coupling a positive polarity voltage pulse generator to the cathode.

BRIEF DESCRIPTION OF THE DRAWINGS

An apparatus according to some of the described embodiments can have several aspects, no single one of which necessarily is solely responsible for the desirable attributes of the apparatus. After considering this discussion, and particularly after reading the section entitled "Detailed Description" one will understand how the features of this invention provide advantages that include the ability to make and use a diode for flash radiography.

DETAILED DESCRIPTION

Figure 1:
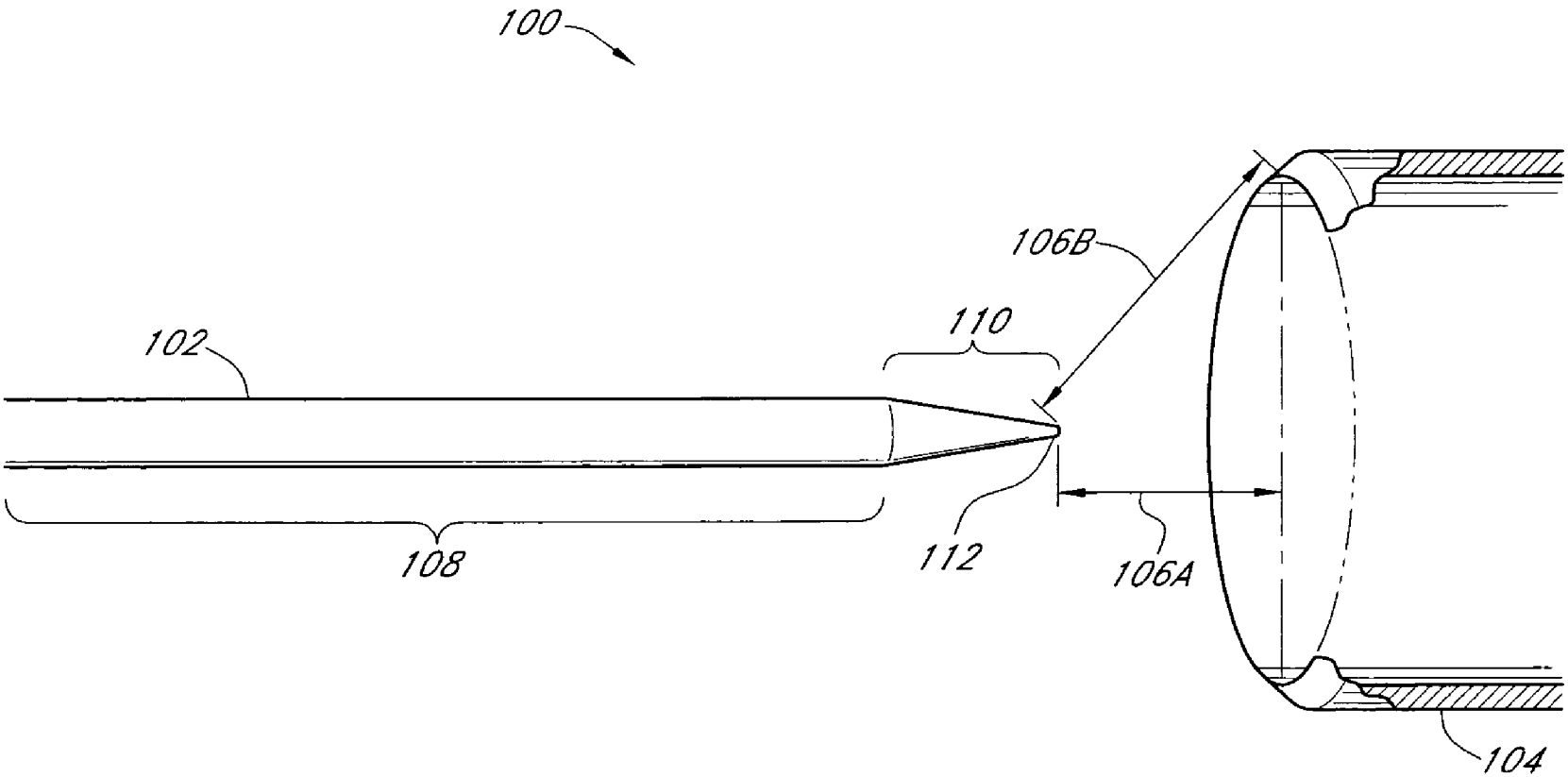
FIG. 1 illustrates a cut-away perspective of a first embodiment of a diode for flash radiography.

As will be appreciated, the following detailed description is directed to certain specific embodiments of the invention. However, the invention can be embodied in a multitude of different ways. One embodiment is directed to a flash radiography diode comprising a cathode, an anode and a gap between the cathode and the anode. The cathode and the anode are housed in a chamber, which is generally held at a pressure below atmospheric pressure. In some embodiments the pressure in the chamber is at or near vacuum. The anode includes a non-tapered portion and tapered portion oriented co-axially with a bore of the cathode, the tapered portion oriented nearest the bore. In some embodiments the cathode comprises a frustum member with the cathode bore and extending through the cathode. In some embodiments the gap is an axial gap between the anode and the cathode. In some embodiments the cathode is configured to emit electrons towards the anode. In some embodiments the electrons striking the anode form an anode plasma, which then emits X rays.

In another embodiment of the present disclosure a method of operating a flash radiography diode comprises providing an electrical pulse from a voltage pulse generator, propagating electrons from an outer surface of a frustum member of a cathode across a gap to a tapered anode and emitting an X ray from a tip of the tapered anode through a bore in the cathode, the bore comprising a smaller diameter close to the tapered anode and a larger diameter further from the tapered anode. In some embodiments the method comprises forming a cathode plasma on a high-field stressed portion of the frustum member. In some embodiments the method comprises forming an anode plasma. In some embodiments the voltage pulse generator is a positive polarity voltage pulse generator electrically connected to the anode. In some embodiments the voltage pulse generator is a negative pulse generator electrically connected to the cathode.

In another embodiment a method of generating ions comprises providing an electrical pulse from a voltage pulse generator, propagating electrons from a cathode to an anode, the cathode connected to the voltage pulse generator and the anode comprising an element to be ionized and ionizing gas molecules emitted from the anode surface. In some embodiments the anode comprises a deuterated plastic. In some embodiments ionizing gas molecules comprises generating neutrons.

In another embodiment a method of making a flash radiography diode comprises forming a cathode comprising a planar member and a frustum member with a bore extending through the frustum member and the planar member, forming a tapered anode comprising an electrically conductive material, placing the tapered anode in a coaxial position with respect to the bore of the frustum member such that a gap exists between the tapered anode and the bore and forming a chamber housing the cathode and the tapered anode.

Generally, there is a need for a higher brightness and a more robust diode source for X ray flash radiography from high-impedance pulsed-power drivers. Further, pulsed-power drivers do not produce enough current at operating voltage for an electron beam to self-magnetically pinch to a small spot size. Brightness increases linearly with X-ray dose and as an inverse square of X-ray spot size. Thus, in some embodiments a diode for flash radiography provides a high brightness from a non-pinched diode source, which is simultaneously robust in terms of shot-to-shot reproducibility. In some embodiments a diode for flash radiography produces an intense electron-beam pinch and accurately and efficiently controls propagation of the beam.

Further, some embodiments are suited for smaller, higher-impedance generators that do not generate the current required to pinch at the operating voltage. A high voltage diode may be used to increase the amount of material the X rays can penetrate and thereby image effectively. Some embodiments include a more robust flash-radiography source with small spot size and high dose that may be driven by high-impedance pulsed-power drivers. In some embodiments the diode is powered by a moderate or low impedance pulsed voltage supply.

In operation, a pulse from a voltage generator causes a cathode plasma to form and emit electrons towards the anode. Electrons emitted from the cathode strike the anode and form an anode plasma at the surface of the anode. The anode plasma provides ions which contribute positive space charge to the region where electrons flow. This permits the flowing electrons to pinch together and allows the electron pinch to propagate along the surface of the anode away from the cathode. An areal velocity of the electron pinch $V_a=\pi DV_z$ (where D is the diameter of the anode and $V_z$ is the axial velocity of the pinch) is constant and is insensitive to the diameter of the anode. Therefore, as a diameter of the anode decreases along the tapered section, the axial velocity of the pinch increases. Further, because the number of electrons about the surface of the anode is constant, the density of the electron beam increases as the diameter of the anode decreases.

Thus, in some embodiments the diode produces a radial flux of ions which, for example, can generate fluxes of neutrons by nuclear reactions induced when the radially moving ions strike a suitable target. In some embodiments the diode provides a source of localized X rays.

Electrons emitted from the cathode impinge on the anode to create X rays via a bremsstralung process, which is described in greater detail below with regard to FIG. 2. In general, however, X rays are created when high energy electron beams (sometimes with 10-30 million electron volts (MeV)) are focused on targets made of materials with high atomic numbers. Interaction with a positively charged atomic nucleus causes an electron to bend (accelerate) and thus to emit photons. The loss of energy from the electron slows the speed of the electrons. In some embodiments of a typical flash radiography application the X rays from bremsstrahlung are then used to create an X-ray image of a fast moving object. A short X-ray pulse is used to reduce blur. A high brightness source with high dose and small spot size may be used to improve resolution. Larger, lower-impedance generators may utilize other types of diodes, such as the rod-pinch diodes described in Mahaffey, R. A., et al., Appl. Phys. Lett. 33, 795 (1978) and Coopersten, G., et al., Phys. Plasmas 8, 4618 (2001), which are hereby incorporated by reference in their entireties. The diodes described in the above-referenced publications rely on self-magnetic pinching to achieve high brightness. Current types of rod-pinch diodes are magnetically limited and forced to the very tip of an anode (pinched), which can yield a very small spot size, often smaller than the anode outer diameter.

A long axial length of X-ray emitting anode may reduce brightness in two ways. First, the off-axis spot size may increase with axial length. Second, a dose amount is reduced and the spot size increases because a longer taper is required for emission from only a tapered portion of the anode. Thus, a uniformly-emitting long taper may produce a spot size comparable to an anode diameter and also reduce on-axis dose due to self absorption of X rays generated inside the anode.

In some embodiments a diode for flash radiography exhibits reproducible small spot size of X-ray emissions. In some embodiments a robustness of the anode is such that the anode may be used multiple times. In some embodiments the anode is smaller than anodes used in previously known diodes. A smaller anode often leads to increased spot size with fuzzy pictures. A reduction in spot size, however, leads to sharper, clearer pictures. To reduce the spot size a thinner anode may be used. However, the thinner anodes may be less robust. If electrons striking the anode spread out over a longer length of the anode, then a comparatively poor spot size is achieved, especially off-axis. Further, various methods exist for providing appropriate electron-beam energy at high electron current so as not to produce unacceptably large spot size on the X-ray production target. One method includes varying pulse length of the voltage pulse. Other methods involve varying the anode and/or cathode geometry within the diode. For example, changing the geometry of the anode to include a tapered section may thus focus electrons on a smaller area, leading to tighter X-ray beam propagation, which results in decreased spot size. These and other aspects are described below with reference to the accompanying figures.

FIG. 1 illustrates a cut-away perspective of a first embodiment of a diode for flash radiography 100. The diode 100 includes an anode 102 and a cathode 104. The anode 102 includes a non-tapered portion 108 and a tapered portion 110 having a section of wide diameter tapered to the anode tip 112 having a narrower diameter. In some embodiments the tapered portion 110 has an axial length of approximately 15, 14, 13, 12, 11, 10, 9, 8, 7, 6, 5, 4, 3, 2, 1 mm or any number in between. In some embodiments the anode 102 includes an electrically conductive material, such as brass, copper, stainless steel, lead, or tantalum. In some embodiments the anode 102 has a diameter of approximately 0.1, 0.2, 0.3, 0.4, 0.5, 0.6, 0.7, 0.8, 0.9, 1.0, 2, 3, 4, 5, 6, 7, 8, 9, 10, 15, 20, 25 mm or any number in between. In some embodiments the anode 102 is coated with a conductive and/or a dielectric material, such as titanium deuteride or grease. In some embodiments the anode coating provides similar or improved performance with respect to increased speed of anode plasma formation. In some embodiments the anode coating affects pinch propagation velocity of the electrons and/or acceleration of iononized gas molecules.

In previous flash radiography diode designs, the anode and cathode were arranged so that expanding plasmas (on the surface of both the anode and the cathode) dynamically affected both diode impedance during an applied voltage pulse and length of the X-ray emission along the anode. Typically, the anode was a tapered rod of high-atomic number material and the cathode was one or more thin disks coaxial with the anode. The anode was positioned through a hole in the cathode. Cathode plasma would initially form on an inside edge of the hole in the cathode. A resultant electron beam would then spread out uniformly along the anode over a distance of approximately twice the anode-cathode gap spacing.

In contrast to the previous diode geometry described above, an axial gap 106A is present between the anode 102 and a center axis of the cathode 104. In some embodiments the anode tip 112 forms one side of the axial gap 106A between the anode 102 and the cathode 104. In some embodiments the axial gap 106A is approximately 0 cm. In some embodiments the axial gap 106A is approximately 0.1, 0.2, 0.3, 0.4, 0.5, 0.6, 0.7, 0.8, 0.9, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 35, 40, 45, 50 mm or any value in between.

A secondary gap 106B is present between a closest edge of the anode 102 and a closest edge of the cathode 104. Since an impedance of the diode 100 may be determined by the secondary gap 106B (the closest distance between an edge of the anode 102 and an edge of the cathode 104), the impedance may be controlled by varying choice of diameter for both the anode 102 and the bore of the cathode 104. The length and outer diameter of the cathode 104 have little influence on the impedance of the diode 100. As discussed below with reference to FIG. 3 the bore may be tapered to control both initial electric field at the cathode 104 and emission properties of the cathode 104. An average pinch propagation velocity is proportional to the average current of the diode 100. Length of the anode 102, however, has little effect on the electrical characteristics of the diode 100.

Upon reaching the tip of the anode 102, an electron beam from the cathode 104 strikes and irradiates a suitable target, such as a pellet placed at the tip of the anode 102 for producing and heating a plasma. A high concentration of electrons striking the tip of the anode 102 produces intense X rays by the rapid deceleration of the electrons in the anode 102 material. The bremsstrahlung (discussed further with reference to FIG. 2) can be enhanced and further localized by positioning a target made from a material having a higher atomic number than that of the anode 102 at the tip of the anode 102. Anode plasma production and X rays from the low-atomic number region of the anode 102 will be reduced, thus minimizing spot size. For the same reason the anode 102 may be coated, except at the region of its tip, with a material having a lower atomic number than the anode 102 such that the rapid deceleration of the electrons produces X rays primarily at the anode tip 112. In some embodiments the anode 102 is heated prior to operation to reduce plasma production and improve diode behavior. Additionally, the taper angle and bluntness of the anode 102 may be varied to improve diode behavior.

In some embodiments the cathode 104 includes a ring-shaped structure positioned co-axially with respect to the anode 102. In some embodiments an inner diameter of the ring-shaped structure nearest the anode 102 is approximately 1, 2, 3, 4, 5, 6, 7, 8, 9, 10, 11, 12, 13, 14, 15 mm or any number in between. In some embodiments an outer diameter of the ring-shaped structure nearest the anode 102 is approximately 1, 2, 3, 4, 5, 6, 7, 8, 9, 10, 11, 12, 13, 14, 15, 20, 25, 30 mm or any number in between. The ring-shaped structure nearest the anode 102 is the section of the cathode 104 acting as the primary source of electrons striking the anode 102. In some embodiments the cathode 104 emits electrons from a space-charge-limited plasma that quickly forms and expands on the active surface.

Generally, a uniform surface of the cathode 104, like the co-axial ring-shaped structure illustrated in FIG. 1, improves uniform emission of electrons striking the anode 102. Other methods for improving uniform electron emission may include variations in cathode 104 geometry, like those illustrated in FIGS. 5 and 6. In some embodiments uniform electron emission is achieved by applying one or more coatings to the cathode 104. In some embodiments the coating comprises a carbon coating or a carbon insert. In some the coating comprises one or more non-conducting materials. In some embodiments the coating is configured to enhance cathode 104 plasma production. In some embodiments the cathode 104 coating is applied to regions of the cathode 104 further from the anode tip 112. In some embodiments the cathode is configured to improve diode behavior and robustness. In some embodiments the cathode coating comprises anodized aluminum.

The robustness of previous designs was also affected because of non-consistent surface preparation electrode positioning. In some previous designs a cathode was specially prepared to achieve consistent results because diode impedance was affected by total cathode surface area emitting electrons. Thus, in some embodiments of the present disclosure the diode impedance is largely unaffected by cathode surface preparation. Further, in previous designs the anode may have needed more precise centering with respect to the cathode 104. This is because the anode-cathode gap was linearly reduced in one direction by a centering error, which is not the case with embodiments of the present disclosure.

In some embodiments the anode 102 is connected to a voltage generator. In some embodiments the voltage generator comprises a positive polarity voltage generator. In some embodiments a positive pulse may be applied to the anode 102 by the positive polarity voltage pulse generator. In some embodiments a duration of the positive pulse is between approximately 10 nanoseconds to 10 microseconds. In some embodiments the duration of the positive pulse is approximately 35 nanoseconds. When the positive pulse is applied to the anode 102, the cathode 104 emits electrons which strike the anode 102.

In a rod-pinch diode current flows in the anode to produce a magnetic field. The striking electrons form a plasma on the anode. The plasma is an electrical conductor and reduces the effective spacing between the anode and cathode. A self-magnetic field causes the electron beam to self-pinch to the anode tip. In a rod-pinch diode an initial emission of the electrons from the cathode is most dense at a location where the cathode electric field is highest, that is, near the location where the gap between the anode and cathode is shortest. In the rod-pinch diode electron trajectories curve and the electrons flow along the portion of the anode to form an electron pinch. The velocity of the pinch and the density of the current increase as a radius of the anode decreases. Thus, the anode taper needed to be gradual and terminate smoothly so that the electron beam continued to follow the surface of the anode. As the beam propagates in the rod-pinch diode, the plasma expands and reduces the gap between the anode and cathode thereby decreasing the overall impedance of the diode.

Unlike with a rod-pinch diode, the voltage generator connected to the embodiment of FIG. 1 has a high source impedance and thus cannot provide current necessary for a rod-pinch diode. Nevertheless, sufficient electrons are generated so that the electron beam is weakly pinched and focused toward the anode tip 112. When the electrons strike the anode 102 then an anode plasma forms. In some embodiments the anode plasma further generates ions, which participate in the electrical conduction of the diode 100.

The radial velocity $V_r$ of the electrons and the strengthened magnetic field $B_\theta$ due to the increased current produce a Lorentz force $F[F=(V_r \times B_\theta)_q]$, which curves the trajectories of the intense electron beam closer to each other, thereby greatly increases an electron density in the direction toward the tip of the anode 102.

In operation an electron-only space-charge-limited impedance may initially be very high. Sometimes, before the peak of a current pulse, the surface of the anode 102 is heated to a high enough temperature to produce an expanding anode 102 plasma. Ions from this anode plasma may dramatically lower the diode impedance through space charge neutralization of the electron beam near the anode 102. They also help produce additional electrons from large radius along the sides of the cathode 104 which increased the length of the anode 102 hit by electrons, further reducing the impedance and increasing the length of the X-ray source along the anode 102. Finally, the expanding anode 102 and cathode 104 plasmas dynamically reduce the effective secondary gap 106B during the pulse and further reduce the diode impedance. In previous diode designs the time-dependent anode 102 and cathode 104 plasma formation was strongly dependent on plasma production thresholds, which made for very difficult numerical or analytical analysis; as the amount of surface area on the anode 102 and cathode 104 covered in plasma grows the impedance of the diode drops dramatically.

Electrons emitted from the edge of the cathode 104 closest to the anode 102 are electrostatically focused toward the tip of the anode 102. Anode plasma forms first on the tip 112 before the rest of the anode 102 because of high electron flux on the tip 112. In some embodiments the anode plasma serves as an ion source for the diode. In some embodiments formation of anode plasma occurs earlier in the pulse because of the focus on the small diameter tip 112. In some embodiments plasma is formed and ions are emitted primarily on the tip 112 and on the anode taper 110.

In some embodiments the surface of the cathode 104 closest to the anode 102 is modified to maximize performance and optimize electrostatic focusing of electrons to the anode tip 112 while limiting emitting area of the cathode 104. Additionally, as mentioned briefly above, the amount of cathode surface area covered by the cathode plasma has substantially little affect on diode impedance. Thus, for purposes of achieving reproducible electron emission and a robust diode, outside surface preparation of the cathode is not essential. Nevertheless, as mentioned herein, in some embodiments surface preparation of the cathode with one or more coatings may be used to achieve more highly focused electron emission. In some embodiments the coatings are carbon coatings.

In some embodiments the tapered portion 110 has an axial length of approximately 7.87 mm. In some embodiments the axial gap 106A is approximately 3 mm. In some embodiments the anode 102 has a diameter of approximately 1.6 mm. In one embodiment an inner diameter of the ring-shaped structure nearest the anode 102 is approximately 8.99 mm. In some embodiments the axial length of the tapered portion, the axial gap and the diameter of the ring-shaped structure nearest the anode scale with anode diameter.

Figure 2:
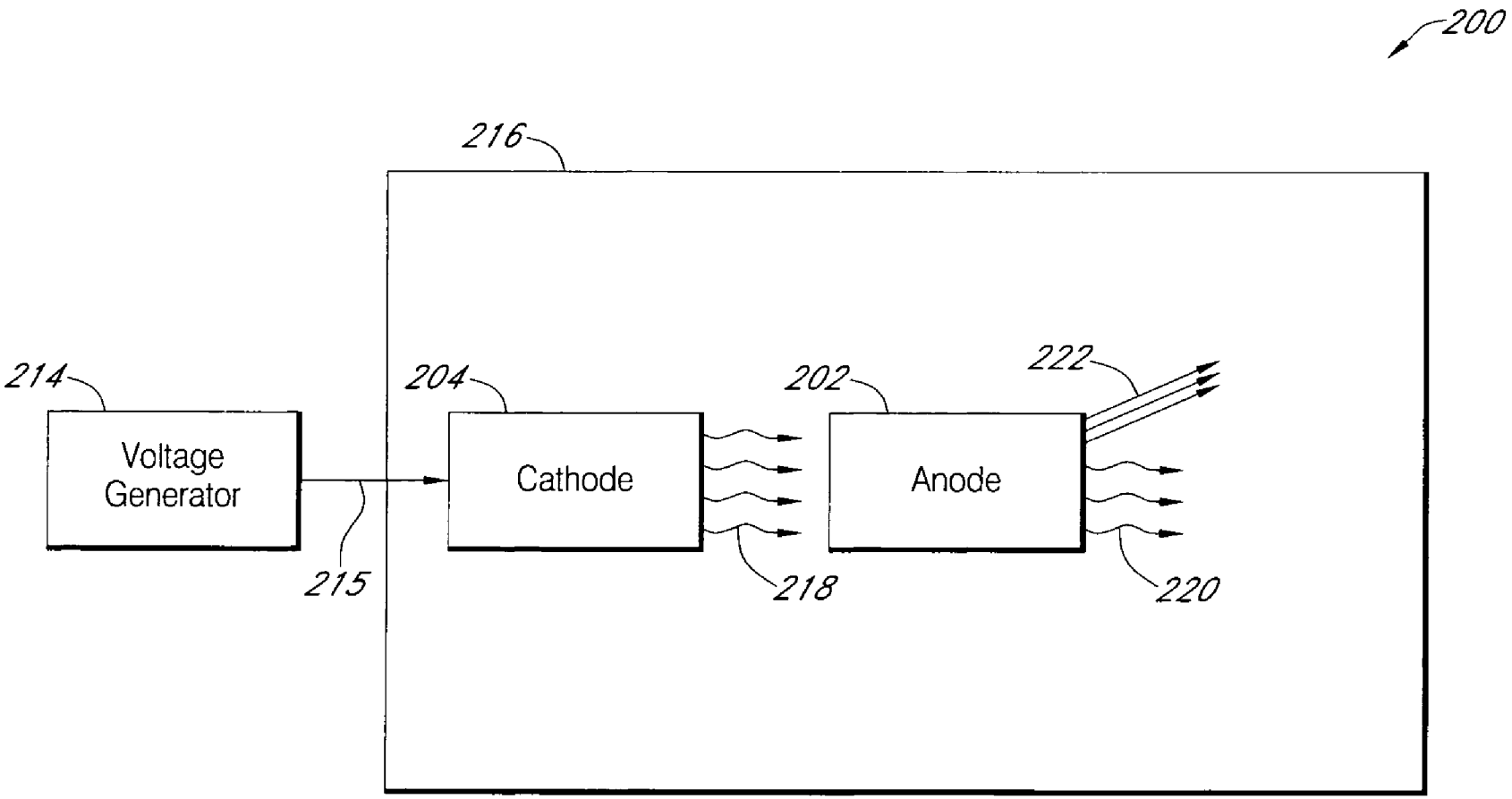
FIG. 2 illustrates a block diagram of a diode for flash radiography.

FIG. 2 illustrates a block diagram of one embodiment of a diode for flash radiography 200. The diode 200 includes an anode 202 and a cathode 204. The cathode 204 is connected to a voltage generator 214 through a connection 215. The cathode 204 and the anode 202 are housed within a chamber 216. Generally, the chamber 216 is at least partially evacuated to have a pressure less than ambient pressure. In some cases the chamber 216 is evacuated to vacuum. In one embodiment the anode 202 and cathode 204 are enclosed within a grounded chamber 216 in which a vacuum below $10^{-3}$ Torr is maintained. The chamber 216 is fabricated from any suitable material, such as stainless steel, which will hold a vacuum. The positive terminal of a high-voltage supply typically passes through an insulating wall of the chamber 216 and connects to the anode 202. In some embodiments the chamber 216 and cathode 204 are electrically connected to ground.

In the embodiment illustrated in FIG. 2 the cathode 204 is electrically connected to a negative voltage pulse generator 214 and the anode 202 is electrically connected to ground. When the voltage generator 214 provides a voltage pulse to the cathode 204 a cathode plasma forms. The cathode plasma causes electrons 218 to be emitted from the cathode 204 to the anode 202. Upon striking the anode 202, the electrons 218 cause an anode plasma to form. The anode 202 then emits electromagnetic radiation 220, usually in the form of X rays.

As mentioned above, the X rays are created from bremsstrahlung and are then used to create an X-ray image of a fast moving object. Bremsstrahlung refers both to a continuous spectrum of electromagnetic radiation produced by deceleration of a first charged particle when deflected by a second charged particle as well as the process of producing the radiation. The first charged particle may be an electron. The second charged particle may be an atomic nucleus.

Bremsstrahlung arises as a result of a charged particle free both before and after a deflection (or an acceleration) interacting with another charged particle to cause an emission from the charged particle. Thus, bremsstrahlung may refer to any radiation due to the acceleration of a charged particle. Generally, however, it is used to describe radiation from electrons stopping in matter. Thus, bremsstrahlung describes radiation emitted when electrons are decelerated or "braked" after being fired at a target. The accelerated charges give off electromagnetic radiation and when the energy of the bombarding electrons is high enough. The electromagnetic radiation useful in flash radiography applications is in the X-ray region of the electromagnetic spectrum. When the energy of the electron beam is increased the radiation created by bremsstrahlung both intensifies and shifts toward higher frequencies.

"Outer bremsstrahlung" refers to energy loss by radiation, which greatly exceeds that by ionization as a stopping mechanism in matter. Generally, outer bremsstrahlung occurs for electrons with energies above 50 keV. "Inner bremsstrahlung" refers to radiation emission during beta decay, resulting in the emission of a photon of energy less than or equal to the maximum energy available in the nuclear transition. Timer bremsstrahlung is caused by the abrupt change in the electric field in the region of the nucleus of the atom undergoing decay, in a manner similar to that which causes outer bremsstrahlung. In electron and positron emission the photon's energy comes from the electron/nucleon pair, with the spectrum of the bremsstrahlung decreasing continuously with increasing energy of the beta particle. In electron capture the energy comes at the expense of the neutrino, and the spectrum is greatest at about one third of the normal neutrino energy, reaching zero at zero energy and at normal neutrino energy. Beta particle emitting substances sometimes exhibit a weak radiation with continuous spectrum due to either or both outer and inner bremsstrahlung.

As noted above, bremsstrahlung is a secondary radiation produced as a result of stopping (or slowing) the primary radiation (electrons). In some cases the bremsstrahlung produced by shielding this radiation with the normally used dense materials (for example, lead) is itself dangerous; in such cases, shielding must be accomplished with low density materials, for example, Plexiglass (lucite), plastic, wood, or water; because the rate of deceleration of the electron is slower, the radiation given off has a longer wavelength and is therefore less penetrating.

Suppose that a particle of charge q experiences an acceleration $\vec{a}$ which, for the sake of simplicity, is collinear with its velocity $\vec{v}$. Then, the relativistic expression for the angular distribution of the bremsstrahlung (considering only the dominant dipole radiation contribution), is $$\frac{dP(\theta)}{d\Omega} = \frac{\mu_0 q^2 a^2}{16\pi^2 c} \frac{\sin^2\theta}{(1-\beta\cos\theta)^5},$$

where $\beta = v/c$ and $\theta$ is the angle between $\vec{a}$ and the point of observation.

Integrating over all angles then gives the total power emitted as $$P = \frac{\mu_0 q^2 a^2 \gamma^6}{6\pi c},$$

where $\gamma(v)$ is a Lorentz factor. This basic treatment shows a very strong dependence on the Lorentz factor, gamma, indicating the amount of bremsstrahlung emitted by the particle increases greatly with its speed, if the speed is at least semi-relativistic. Thus, for a given fixed particle energy E, the amount of bremsstrahlung emitted by a particle has a strong dependence on the particle's mass, since $\gamma = E/(mc^2)$. In this case, $P \alpha m^{-6}$ for a fixed energy, so if an electron and muon have the same energy, the electron will emit $(m_\mu/m_e)^6=207^6=7.87\times10^{13}$ times more radiation than the muon. Thus, because muons lose comparatively little energy due to bremsstrahlung they have comparatively high penetrating power.

The general expression for the total radiated power is $$P = \frac{q^2\gamma^4}{6\pi \in_0 c}\left(\dot{\beta}^2 + \frac{(\vec{\beta}\cdot\dot{\beta})^2}{1-\beta^2}\right)$$

where $\dot{\beta}$ signifies a time derivative.

Apart from emission of X rays, the intense electron-beam flux 218 impinging on the anode 202 causes both an anode surface temperature to rise quickly and gas molecules to be emitted and ionized. The ionized gas 222 expands from the anode surface as a plasma. The ions 222 within the plasma accelerate radially outward from the anode 202. The ion flux is controlled by the production of plasma which depends on the material on the surface of the anode 202. This process is discussed further in conjunction with FIG. 3.

Figure 3:
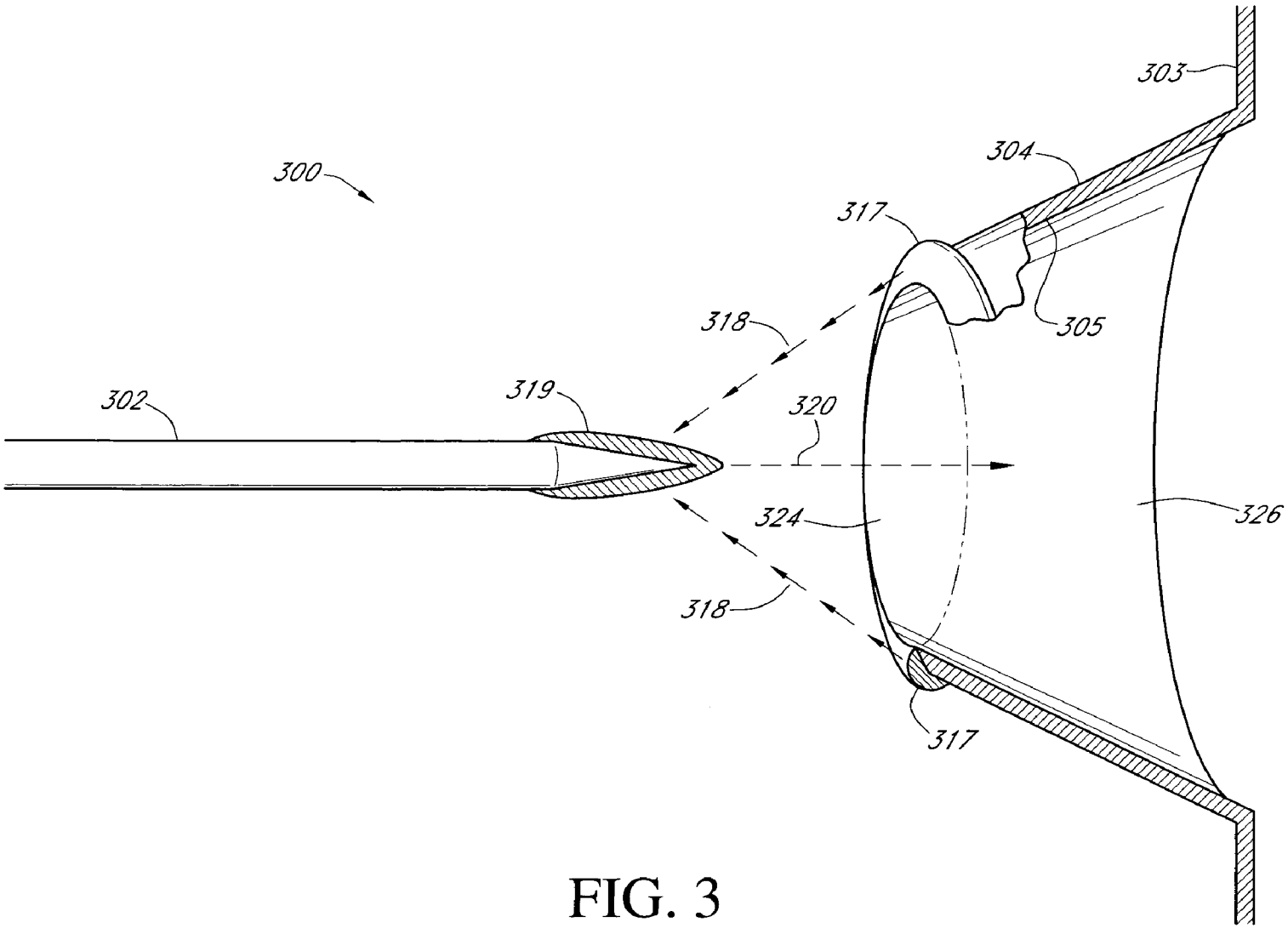
FIG. 3 illustrates a cut-away perspective of a second embodiment of a diode for flash radiography.

FIG. 3 illustrates a cut-away perspective of a second embodiment of a diode for flash radiography 300. The diode 300 includes both an anode 302 and a cathode 304. The cathode 304 includes both a plate 303 and a frustum member 305. In some embodiments the longitudinal axis of the anode 302 is approximately concentric with the longitudinal axis of the bore of the frustum member 305 such that an axis extends coaxially from the anode 302 through the bore of the cathode 304. In some embodiments the anode 302 has a width of approximately 0.1, 0.2, 0.3, 0.4, 0.5, 0.6, 0.7, 0.8, 0.9, 1.0, 2, 3, 4, 5, 6, 7, 8, 9, 10, 15, 20, 25 mm or any number in between. In some embodiments the anode 302 has a width of approximately 1.6 mm. In some embodiments the tapered portion of the anode 302 has an axial length of approximately 15, 14, 13, 12, 11, 10, 9, 8, 7, 6, 5, 4, 3, 2, 1 mm or any number in between. In some embodiments the tapered portion of the anode 302 has an axial length of approximately 7.87 mm.

As in the embodiment illustrated in FIG. 1, the anode 302 and the cathode 304 are separated by an axial gap. In some embodiments the frustum member 305 of the cathode 304 is oriented on a first side of the axial gap and the anode 302 is oriented on a second side of the axial gap. In some embodiments the axial gap comprises a distance of approximately 0, 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 6.0, 7.0, 8.0, 9.0, 10.0 mm or any number in between. In some embodiments the axial gap comprises a distance of approximately 3.0 mm. In some embodiments the anode 302 includes a tapered rod oriented so that the tapered rod is closest to the second side of the axial gap. The anode 302 is coupled to a pulsed voltage supply.

In some embodiments the cathode 304 includes a frustum member 305. The cathode 304 includes a material, such as carbon, which rapidly emits electrons during the early stage of an applied voltage pulse. Cathode 304 materials may be used to minimize cost or maximize performance. The cathode 304 may comprise any suitable shape. In some embodiments the cathode has a length of approximately 10, 11, 12, 13, 14, 15, 16, 17, 18, 19, 20, 21, 22, 23, 24, 25, 30, 35 or 40 mm. In some embodiments the cathode 304 has a length of approximately 17.22 mm. In this embodiment the cathode 304 includes a frustum member 305 with flat surfaces flaring from a first diameter nearest the anode tip to a larger second diameter further from the anode tip. The frustum member has a bore which is preferably symmetrical about the longitudinal axis of the cathode 304. The bore extends the entire length of the cathode 304. The cathode 304 includes a bore running through it. The bore is relatively short, so that X rays emitted from the anode 302 move through the bore in the cathode 304. In some embodiments the bore is structured as a frustum member so that no portion of the cathode 304 blocks a field of view created by the X rays emitted from the anode 302. In some embodiments the length of the bore through the cathode 304 frustum member is varied based on a required unobstructed field of view between anode 302 tip and X-ray window.

In some embodiments the anode 302 and the cathode 304 are housed in a chamber. In some embodiments the chamber is an evacuated chamber. In some embodiments the anode 302 is electrically connected to ground and the cathode 304 is electrically connected to a negative voltage pulse generator. In some embodiments the frustum member 305 is electrically connected to ground and the anode 302 is electrically connected to a positive-polarity voltage pulse generator.

In operation the voltage pulse generator generates a voltage pulse to the anode 302 causing a cathode plasma 317 to form on the high-field stress portions of the cathode 304. Electrons 318 are emitted from the cathode plasma 317 and strike the anode 302. In some embodiments the electrons strike a tapered portion of the anode 302 generating bremsstralung X-ray radiation 320. The X-ray radiation 320 is propagated along an axis of the anode 302 through an X-ray window. In some embodiments a diameter of the anode 302 is so small that the tapered end of the anode 302 fragments due to the large energy density deposited during generation of the X-ray radiation 320. Thus, in some embodiments before a second pulse the tapered portion of the anode 302 is replaced. In some embodiments the cathode 304 is configured to withstand multiple voltage pulses. In some embodiments the cathode 304 is configured to withstand 10 voltage pulses. In some embodiments the cathode 304 is configured to withstand 20, 30, 30, 40, 50, 60, 70, 80, 90, 100, 200, 300, 400, 500, 600, 700, 80, 900, 1000, 1100, 1200, 1300, 1400, 1500 voltage pulses or any number between.

Any high-voltage supply capable of producing a large pulse within the range of hundreds of kilovolts to megavolts may be utilized with embodiments of the present disclosure. In some embodiments a duration of the pulse is between approximately 10 nanoseconds to 10 microseconds. In some embodiments the duration of the pulse is approximately 35 nanoseconds.

When a voltage pulse is provided to the cathode 304 a cathode plasma 317 forms on the portion of the cathode 304 closest to the anode 302. The cathode plasma 317 emits electrons 318 that strike the anode 302. As illustrated in FIG. 3, the electrons 318 strike the tapered portion of the anode 302 creating an anode plasma 319 localized in the area of the tapered portion of the anode 302 near the tip of the anode 302. The anode 302 emits X rays 320 in a relatively concentrated stream propagated from the axis of the anode 302 through the bore of the frustum member 305. The X rays 320 enter the frustum member 305 through a frustum member mouth 324 and exit through a frustum member end 326. In some embodiments a diameter of the mouth 324 is approximately 1, 2, 3, 4, 5, 6, 7, 8, 9, 10, 11, 12, 13, 14, 15 mm or any number in between. In one embodiment the diameter of the mouth 324 is approximately 8.99 mm. In some embodiments the diameter of the frustum member end 326 is larger than the diameter of the frustum member mouth 324.

Figure 4:
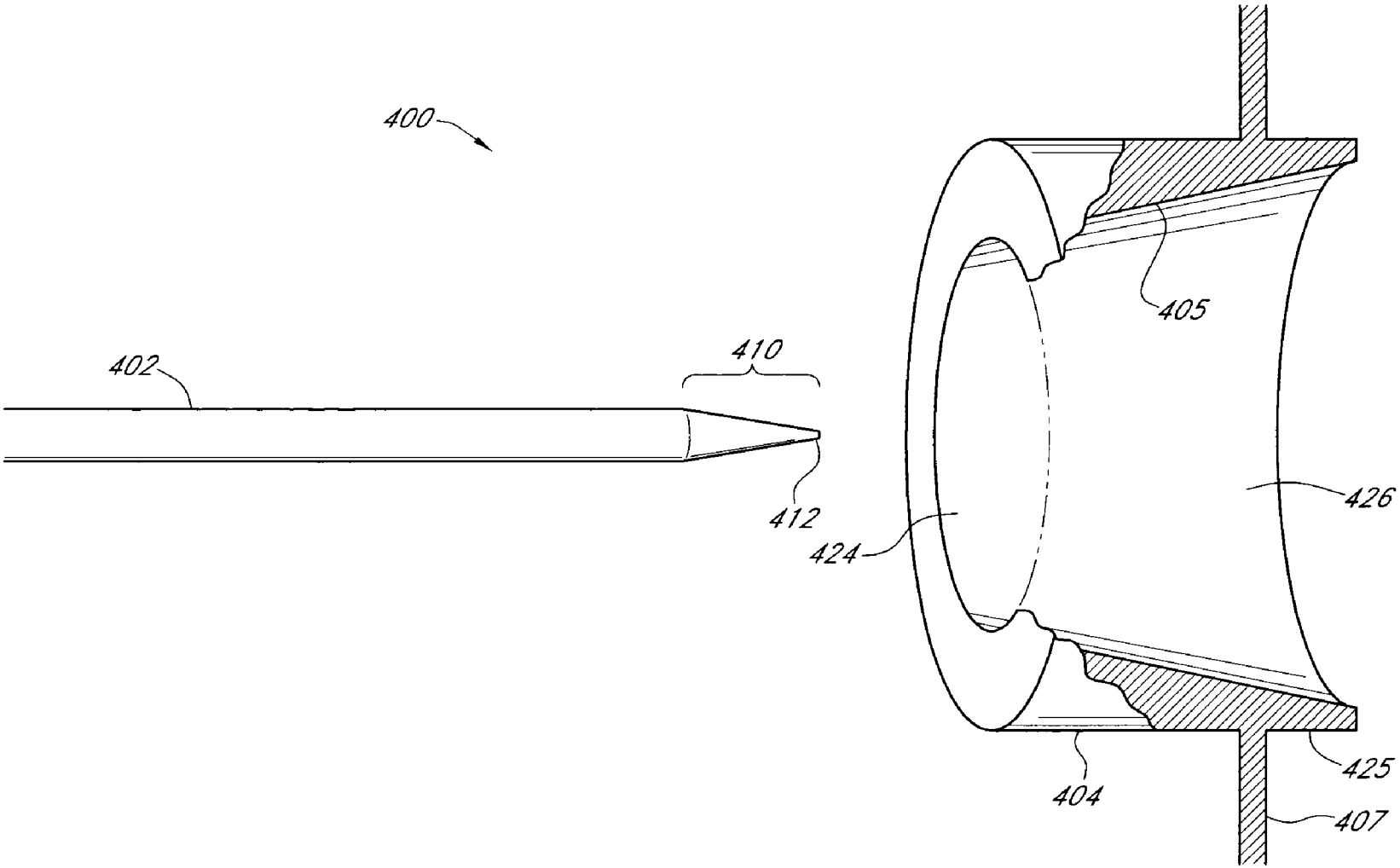
FIG. 4 illustrates a cut-away perspective of a third embodiment of a diode for flash radiography.

FIG. 4 illustrates a cut-away perspective of a third embodiment of a diode for flash radiography 400. The diode 400 includes an anode 402 and a cathode 404. The anode 402 includes a tapered portion 410 that ends with a blunted tip 412. The cathode 404 comprises a cylindrical outer portion and a frustum member 405 including a hollow bore through the cathode 404. The cathode is also connected to a plate 407, which is electrically connected to a voltage generator (not shown). A diameter of a frustum member mouth 424 increases to a larger diameter of a frustum member end 426. The cathode 404 is illustrated with an extension 425 of the cathode 404 past a plane created by the plate 407. As noted above with regard to FIG. 1, since an impedance of the diode 400 may be determined by a closest distance between an edge of the anode 402 and an edge of the cathode 404, the impedance may be controlled by varying choice of diameter for both the anode 402 and the bore of the cathode 404. The length and outer diameter of the cathode 404 have little influence on the impedance of the diode 400. Thus, the particular cylindrical outer shape of the cathode 404 does not substantially affect impedance of the diode 400.

Figure 5:
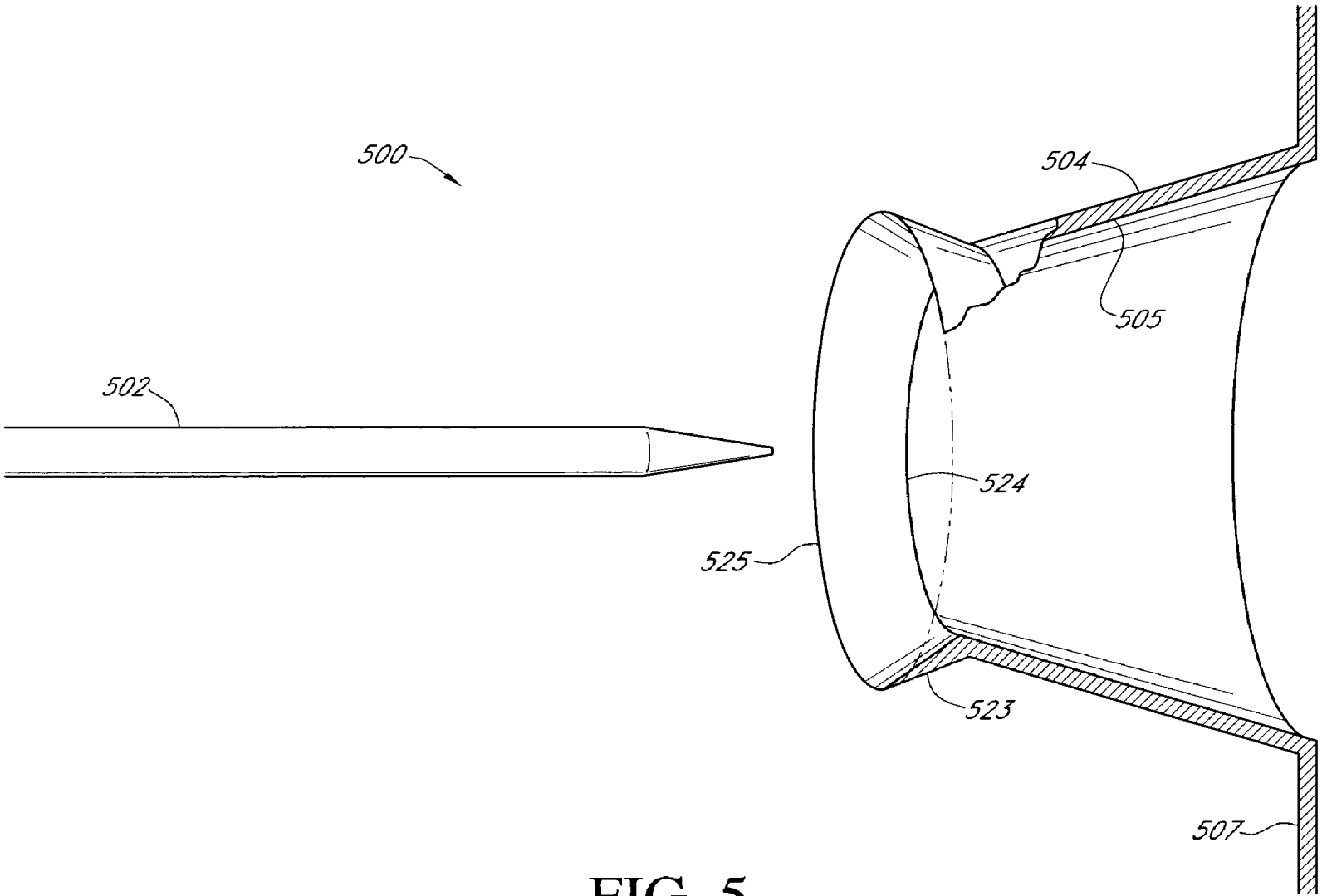
FIG. 5 illustrates a cut-away perspective of a fourth embodiment of a diode for flash radiography.

FIG. 5 illustrates a cut-away perspective of a fourth embodiment of a diode for flash radiography 500. The diode 500 includes an anode 502 and a cathode 504. The cathode 504 includes a frustum member 505 and is attached to a plate 507. The cathode 504 also includes a flange 523 that flares outward from its attachment to the frustum member 505. Thus, a diameter of the flange edge 525 closest to the anode 502 is greater than a diameter of the frustum member mouth 524. The flange 523 provides a uniform surface area for cathode plasma to emit electrons towards the surface of the anode 502.

As mentioned above with regard to FIG. 1, a uniform surface of the flange 523 improves uniform emission of electrons striking the anode 502. In addition to the flange 523, uniform electron emission can be improved by applying one or more coatings to the flange 523 or other portions of the cathode 504. In some embodiments the coating is a carbon coating or a carbon insert. In some embodiments the coating is a non-conducting material. In some embodiments the coating is configured to enhance cathode plasma production. In some embodiments the coating is configured to improve diode behavior and robustness. In some embodiments the coating comprises anodized aluminum.

Figure 6:
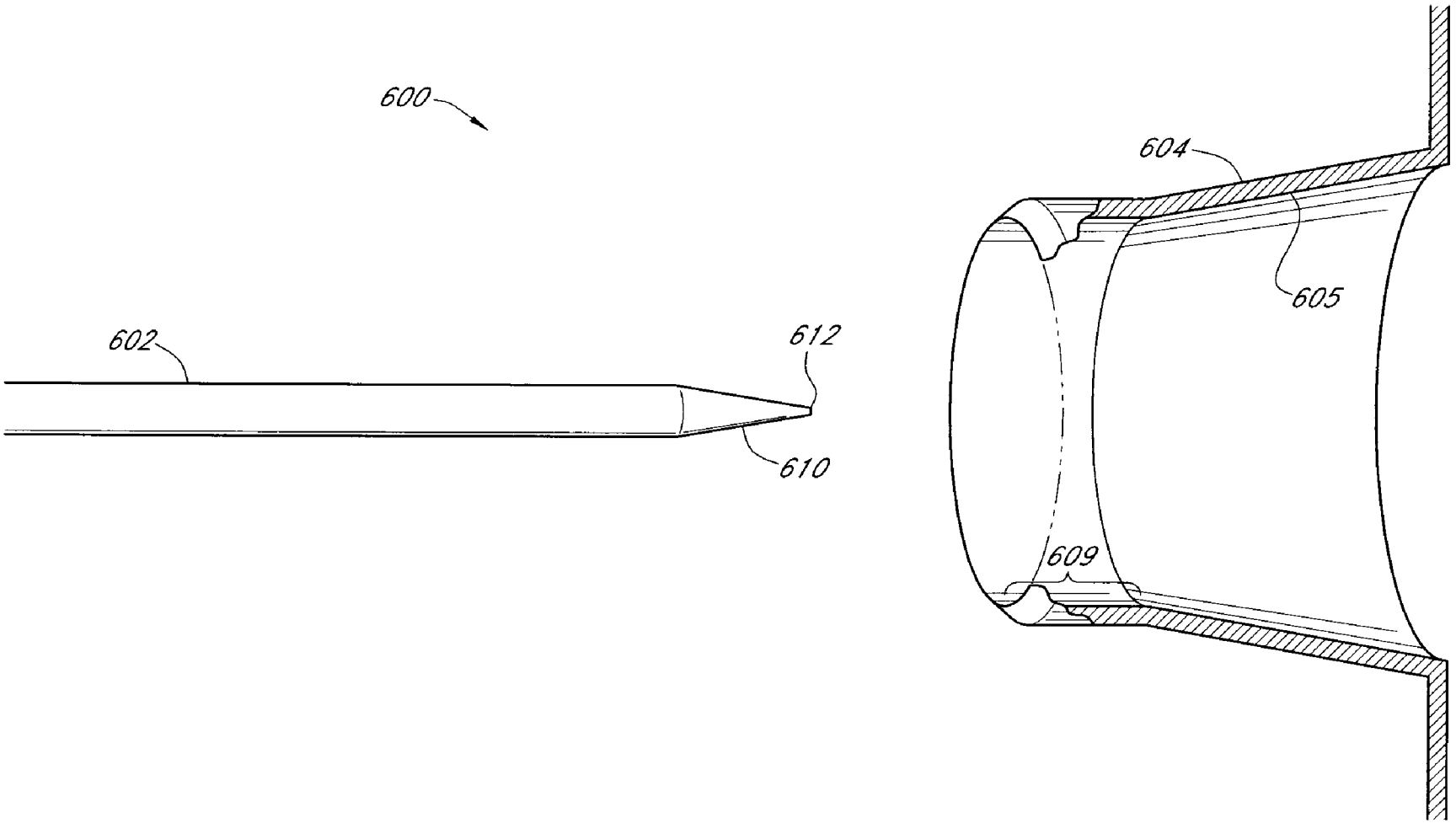
FIG. 6 illustrates a cut-away perspective of a fifth embodiment of a diode for flash radiography.

FIG. 6 illustrates a cut-away perspective of a fifth embodiment of a diode for flash radiography 600. The diode 600 includes an anode 602 and a cathode 604. The anode includes a tapered portion 610 and a tip 612. The cathode 604 illustrates a frustum member 605 attached to a cylindrical portion 609. The cylindrical portion 605 of the cathode 602 stretches towards the anode 602 and provides a uniform surface area for cathode plasma to emit electrons towards the anode 602. As noted above with respect to FIGS. 1 and 5, uniform electron emission can be improved by applying one or more coatings to the cathode 604. Such coatings may be applied to the cylindrical portion of the cathode 604 and/or to other portions of the cathode 602. In some embodiments the coating comprises a carbon coating or a carbon insert. In some embodiments the coating is a non-conducting material. In some embodiments the coating is configured to enhance cathode plasma production. In some embodiments the coating is configured to improve diode behavior and robustness. In some embodiments the coating comprises anodized aluminum.

Figure 7:
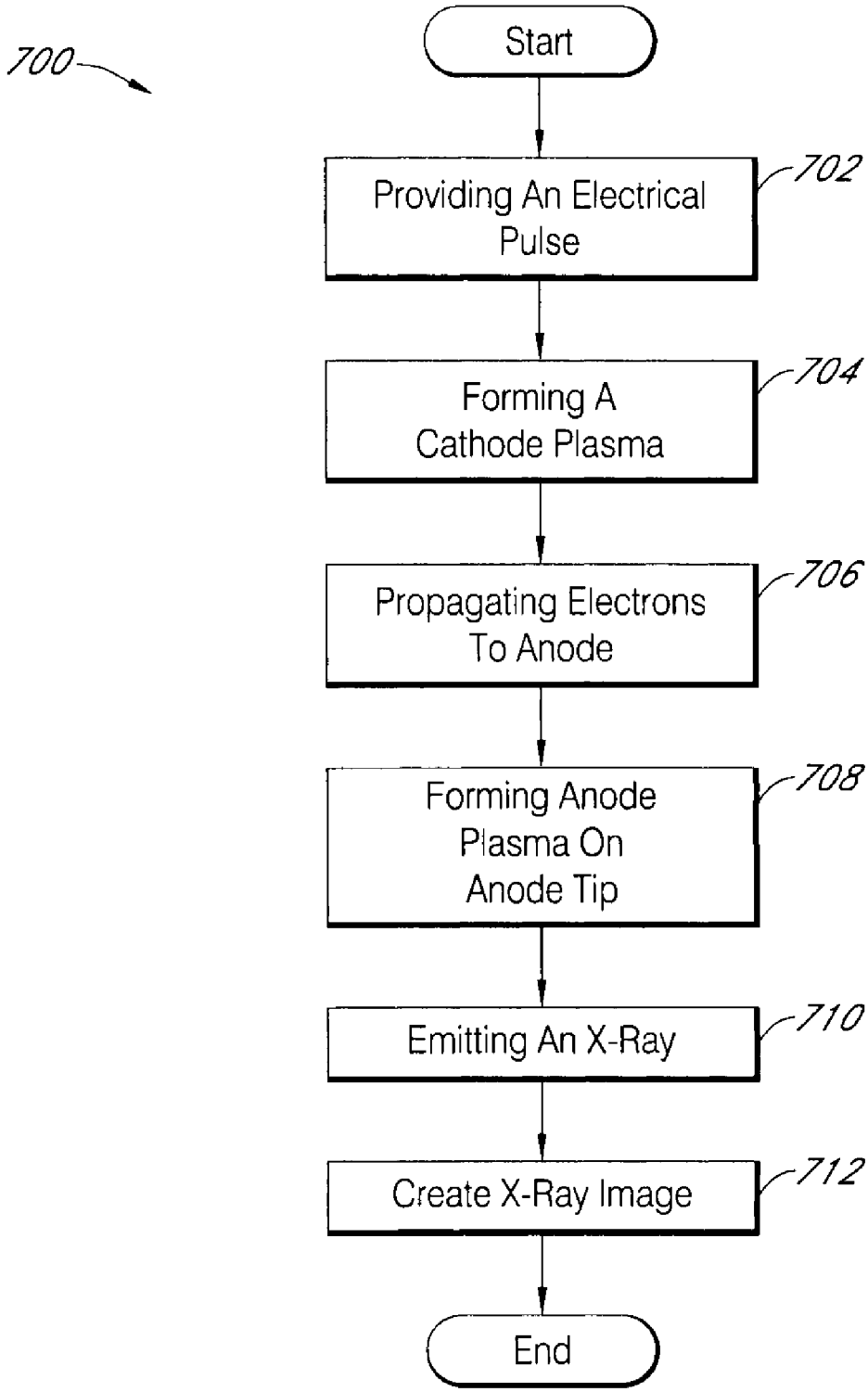
FIG. 7 illustrates a flow chart of one method of using a flash radiography diode.

FIG. 7 illustrates a first flow chart 700 illustrating one method of using a flash radiography diode. The method starts with providing an electrical pulse 702. Generally, as described above with reference to FIG. 2, the electrical pulse is provided to the cathode from an electrical pulse generator. In some embodiments the electrical pulse generator is a positive polarity pulse generator electrically connected to the anode. As an alternative electrical configuration, the anode may be grounded and a negative-polarity pulse may be applied to the cathode by the voltage supply. Thus, pulsed power generators that only supply negative pulses may be used. In this configuration illustrated in the block diagram of FIG. 7 the anode is at ground potential.

The electrical pulse provided to the cathode will cause forming of cathode plasma 704 generally at the areas of the cathode nearest to the anode. The formation of anode plasma causes emission of electrons and propagating of electrons to the anode 706. Where the electrons strike the anode will cause a forming of an anode plasma 708 on the surface of the anode. Generally, as discussed above, the anode plasma forms nearest the tip of the anode and will cause emitting of X rays 710 from the anode. Although other electromagnetic radiation may also be emitted from the anode, the emission of the X rays from the anode may be used for creating an X-ray image 712 of a fast moving object. Further, in some embodiments the creation of anode plasma will cause the ionization of one or more gas molecules created on the surface of the anode. After creating the X-ray image 712 the method ends.

Figure 8:
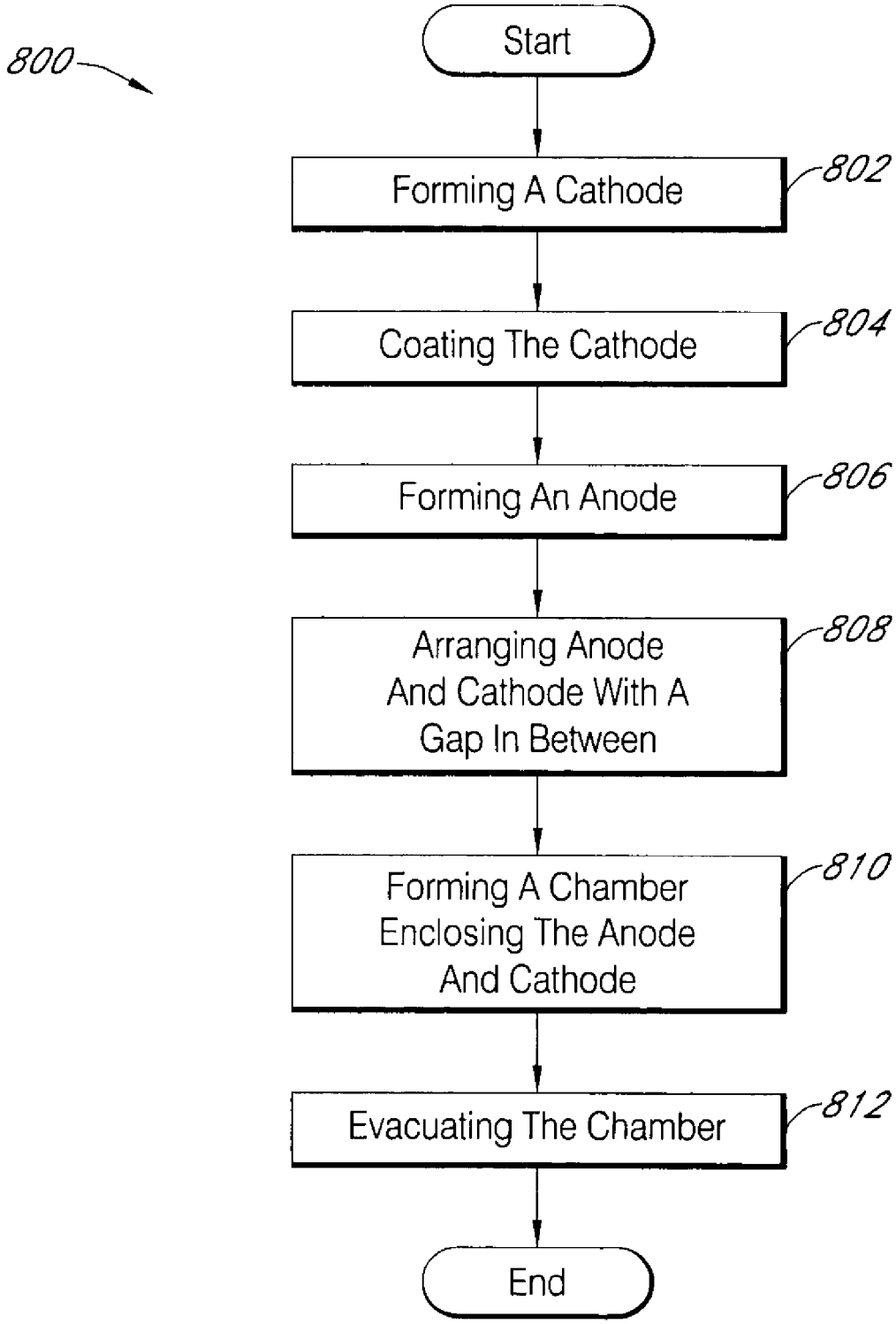
FIG. 8 illustrates a flow chart of one method of making a flash radiography diode.

FIG. 8 illustrates a second flow chart 800 illustrating a method of making a flash radiography diode. As illustrated in the second flow chart 800 the method starts by forming a cathode 802 and coating the cathode 804. As discussed above, the cathode may be formed of suitable materials in a variety of shapes. The cathode may then be coated by a variety of suitable materials to allow for improved cathode plasma formation. In forming an anode 806 the anode may include both a rod portion and a tapered portion connected together. Thus, a diameter of the rod portion tapers to a tip of the anode. The method also includes a step of arranging the anode and the cathode with a gap in between 808. The anode is arranged so that the tip of the anode is the portion of the anode positioned closest to an axis of the cathode and the gap exists between the tip of the anode and the axis of the cathode. The next method steps include forming a chamber enclosing the anode and the cathode 810 and evacuating the chamber 812. As discussed above, the chamber may be evacuated to a pressure less than ambient pressure. In some embodiments the chamber is evacuated to near vacuum.

Some embodiments of the present disclosure have the advantage of high brightness including both small spot size and high dose. The high brightness is achieved both on and off axis. Further, some embodiments of the present disclosure exhibit a robust impedance behavior when driven over a wide range of voltages (between 100 kV and 20 MV) by high-impedance pulsed-power drivers that do not produce enough current at their operating voltage to allow the electron beam to self-magnetically pinch. Some or all of the above advantages are achieved using a diode geometry of the flash radiography diodes of the present disclosure. The diode geometry controls the extent of anode plasma formation and limits interactions of anode and cathode plasma expansions on diode impedance behavior.

Further, in some embodiments of the present disclosure, the anode tip is easily observable from the side of the diode. Thus, the anode tip may be inspected for wear without dismantling the system. Since previous diodes required dismantling of the diode to inspect the anode tip, the particular diode geometry described in embodiments herein provides a major benefit for systems requiring multiple shots with the same anode.

Once ion emission begins, the diode impedance falls a factor of 4 to 6 and reaches a steady equilibrium value largely unaffected by non-interacting expanding anode plasma and cathode plasma. In some embodiments the anode plasma expands primarily in a radial direction and not toward the cathode—unlike anode plasmas in the prior art. The radial expansion of anode plasma improves robustness because centering of the anode is not critical. The gap between off-centered anode tip and various portions of the cathode does not initially vary. Further, the radial expansion of anode plasma does not affect the expansion of the cathode plasma and does not substantially affect the diode impedance. Thus, some embodiments of the present disclosure utilize smaller diameter anodes and smaller gaps between the anode and the cathode while still achieving a robust diode impedance behavior and an inherently small spot size in comparison with those of the prior art.

Because of the anode-cathode geometry, the length of ion emission has only a weak effect on diode impedance. Since the electrons impinge the anode primarily where ions are emitted, the X-ray source is the tip of the anode. This results in significant advantages in flash radiography including small spot size both on and off axis and high does in the forward direction. Another advantage of the anode-cathode geometry is that diode impedance is approximately proportional to the distance of a surface gap between a surface of the anode and a surface of the cathode. In some embodiments the diode may be driven by an impedance much greater than 100 Ohms (>>100ω) pulsed-power voltage generators. Cylindrical diodes in the prior art required comparatively large cathode radii and comparatively large axial X-ray spot sizes to achieve the high impedances of diodes of the present disclosure. Existing and prior art X-ray machines, such as Pulserad series from L-3 Titan, PSD and Scandiflash may be retrofit using diodes of the present disclosure to achieve increased dose at smaller spot size.

In another embodiment a plurality of anodes may be connected in parallel to a high-voltage supply, extended towards a cathode, curved at angles at a point along sections of narrow diameter and pulsed simultaneously. An electron-beam pinch propagates along each curved anode at an angle as large as approximately 160° over a few centimeters. Curving the anode in a single or multi-anode application provides more control over the application of the beam pinch.

The foregoing description details certain embodiments of the invention. It will be appreciated, however, that no matter how detailed the foregoing appears in the text, the invention can be practiced in additional ways. It should also be noted that the use of particular terminology when describing certain features or aspects of the invention should not be taken to imply that the terminology is being re-defined herein to be restricted to include any specific characteristics of the features or aspects of the invention with which that terminology is associated. Further, numerous applications are possible for devices of the present disclosure. It will be appreciated by those skilled in the art that various modifications and changes may be made without departing from the scope of the invention. Such modifications and changes are intended to fall within the scope of the invention, as defined by the appended claims.

| | |
|---|---|
| 100 | Diode |
| 102 | Anode |
| 104 | Cathode |
| 106A | Axial Gap |
| 106B | Direct Gap |
| 108 | Non tapered portion |
| 110 | Tapered portion |
| 112 | Tip |
| 200 | Diode |
| 202 | Anode |
| 204 | Cathode |
| 214 | Voltage Generator |
| 215 | Connection to Cathode |
| 216 | Housing |
| 218 | Electrons |
| 220 | X rays |
| 222 | Ionized Gas |
| 300 | Diode |
| 302 | Anode |
| 304 | Cathode |
| 305 | Frustum Member |
| 307 | Plate |
| 317 | Cathode Plasma |
| 318 | Path of Electrons |
| 319 | Anode Plasma |
| 320 | Path of X ray |
| 324 | Mouth of Frustum Member |
| 326 | Back of Frustum Member |
| 400 | Diode |
| 402 | Anode |
| 404 | Cathode |
| 405 | Frustum Member |
| 407 | Plate |
| 500 | Diode |
| 502 | Anode |
| 504 | Cathode |
| 505 | Frustum Member |
| 507 | Plate |
| 523 | Flange |
| 524 | Mouth of Frustum Member |
| 525 | Mouth of Flange |
| 600 | Diode |
| 602 | Anode |
| 604 | Cathode |
| 605 | Frustum Member |
| 609 | Cylindrical Portion |
| 610 | Tapered Portion |
| 612 | Tip |
| 700 | Flow Chart for Method of Using |
| 702 | Providing An Electrical pulse |
| 704 | Forming a Cathode plasma |
| 706 | Propagating Electrons to Anode |
| 708 | Forming Anode plasma |
| 710 | Emitting X ray |
| 712 | Creating X-ray image |
| 800 | Method of making Diode for Flash Radiography |
| 802 | Forming a Cathode |
| 804 | Coating the Cathode |
| 806 | Forming an anode |
| 808 | Arranging the anode and cathode with a gap in between |
| 810 | Forming a chamber enclosing the anode and cathode |
| 812 | Evacuating the chamber |

What is claimed is:

1. A flash radiography diode, comprising:

a cathode comprising a frustum member with a bore extending through the frustum member;

a tapered anode comprising an electrically conductive material, the cathode and the tapered anode housed in a chamber, wherein the cathode is configured to emit an electrical pulse to the tapered anode;

a gap between the tapered anode and the frustum member; and wherein the frustum member further comprises a flange having an outwardly flared wall at a first end proximate to the anode.

2. The flash radiography diode of claim 1, wherein the cathode comprises carbon.

3. The flash radiography diode of claim 1, wherein the tapered anode comprises at least one material selected from the group consisting of brass, copper, tungsten, tungsten alloy, stainless steel, lead and tantalum.

4. The flash radiography diode of claim 1, wherein a taper of the tapered anode is 20 degrees.

5. The flash radiography diode of claim 1, wherein the frustum member comprises a cylindrical portion.

6. The flash radiography diode of claim 1, wherein the flange is at least partially coated with carbon.

7. The flash radiography diode of claim 1, wherein the frustum member projects from a base of the cathode towards the tapered anode.

8. The flash radiography diode of claim 7, wherein the bore comprises a conical shape comprising a first opening with a first diameter at the first end and a second end with a second diameter, the first diameter smaller than the second diameter and the first end located closer to the tapered anode than the second end.

9. The flash radiography diode of claim 1, wherein the gap comprises an axial gap between the tapered anode and the bore and wherein the axial gap is between 1 and 3 mm.

10. The flash radiography diode of claim 1, wherein the anode comprises a coating element with an atomic number greater than 55.

11. The flash radiography diode of claim 10, wherein the element is tungsten or uranium.

12. The flash radiography diode of claim 1, wherein non-tip portions of the tapered anode comprise a carbon coating configured to increase ion emission threshold.

13. The flash radiography diode of claim 1, wherein non-tip portions of the tapered anode comprise at least one material selected from the group consisting of an element having an atomic number less than 55, carbon, aluminum or titanium, the at least one material configured to increase the ion emission threshold of the anode.

14. The flash radiography diode of claim 1, wherein the bore is coaxial with the tapered anode.

15. The flash radiography diode of claim 1, wherein the tapered anode is replaceable.

16. The flash radiography diode of claim 1, wherein the non-tapered portion of the tapered anode comprises a hollow rod.

17. The flash radiography diode of claim 16, wherein the hollow rod comprises at least one element with an atomic number less than 55.

18. The flash radiography diode of claim 1, wherein the cathode is connected to ground.

19. The flash radiography diode of claim 1, wherein the chamber is an evacuated chamber.

20. The flash radiography diode of claim 1, wherein the cathode comprises a carbon coating or a carbon insert.

21. The flash radiography diode of claim 1, wherein the cathode comprises an anodized aluminum configured to minimize plasma production on the remainder of the cathode.

22. The flash radiography diode of claim 1, further comprising a positive polarity voltage pulse generator coupled to the cathode.

23. A method of operating a flash radiography diode, comprising:

providing an electrical pulse from a voltage pulse generator to a cathode;

propagating electrons from an outer surface of a frustum member of the cathode across a gap to a tapered anode;

emitting an X ray from a tip of the tapered anode through a bore in the cathode, the bore comprising a smaller diameter close to the tapered anode and a larger diameter further from the tapered anode; and wherein the frustum member includes a flange having an outwardly flared wall at a first end proximate to the anode.

24. The method of claim 23 further comprising heating the anode.

25. The method of claim 23 further comprising forming plasma on a high-field stressed portion of the frustum member.

26. The method of claim 25, wherein electrons from the plasma strike a tip of the tapered anode.

27. The method of claim 23, wherein propagating electrons comprises electrostatically focusing electrons emitted from the cathode towards a tip of the anode.

28. The method of claim 23 further comprising forming an anode plasma on the tip of the anode because of high electron flux.

29. The method of claim 28 further comprising expanding the anode plasma in a primarily radial direction.

30. A method of generating ions, comprising:

providing an electrical pulse from a voltage pulse generator;

propagating electrons from a cathode to an anode, the cathode connected to the voltage pulse generator and the anode comprising an element to be ionized;

ionizing gas molecules emitted from the anode surface; and wherein the cathode includes a frustum member having a flange with an outwardly flared wall at a first end proximate to the anode.

31. The method of claim 30, wherein the anode comprises a deuterated plastic.

32. The method of claim 31, wherein ionizing gas molecules comprises generating neutrons.

* * * * *